United States Patent [19]

Gardner

[11] 4,111,417

[45] Sep. 5, 1978

[54] TORSO EXERCISER

[76] Inventor: James A. Gardner, 9200 H. N. Arch Village, Richmond, Va. 23235

[21] Appl. No.: 768,361

[22] Filed: Feb. 14, 1977

[51] Int. Cl.[2] ..... A63B 21/04

[52] U.S. Cl. ..... 272/136; 272/141

[58] Field of Search ..... 272/141, 143, 135, 62, 272/63, 109, 138, 144

[56] References Cited

U.S. PATENT DOCUMENTS

| | | | |
|---|---|---|---|
| 818,242 | 4/1906 | Geisel | 272/141 |
| 3,938,803 | 2/1976 | Wilmoth et al. | 272/141 X |
| 3,992,004 | 11/1976 | Feron et al. | 272/141 |

FOREIGN PATENT DOCUMENTS

| | | | |
|---|---|---|---|
| 860,811 | 1/1971 | Canada | 272/114 |
| 532,482 | 1/1941 | United Kingdom | 272/144 |

*Primary Examiner*—William R. Browne

[57] ABSTRACT

The exerciser comprises an elongated frame which is supported parallel and close to a horizontal support surface. The frame includes a pair of spaced parallel longitudinal members, each of which is hollow and has an open slot in its top side. A pair of longitudinally spaced handles having depending legs at opposite ends thereof span the space between slots in the two longitudinal frame members. The legs of each of the handles extend through the open slots of the longitudinal members and are secured to a separate pair of slides which are slidably mounted in the hollow longitudinal members. Compression coil springs within the longitudinal members on opposite sides of the slides bias the handles to a neutral position where each handle is spaced on opposite sides of the longitudinal center of the frame by a distance approximately equal to one-half of the distance between the user's arms. The springs act as both shock absorbers and as a form of resistance to sliding motion of the handles which can be adjusted by the user. A chest pad is placed in the mid-section of the frame between the handles.

9 Claims, 10 Drawing Figures

TORSO EXERCISER

BACKGROUND OF THE INVENTION

1. Field of the Invention:

The invention relates to a torso exerciser which facilitates the use of the common push-up position in the development of the upper torso and which is convertible for use in development of the muscles of the inside and outside areas of the user's knees and the groin areas of both legs.

2. Description of the Prior Art:

The present invention distinguishes over other exercisers of the prior art in that it is specifically designed to facilitate the use of the common push-up position to exercise the upper torso and includes floor supports for supporting a pair of parallel transversely spaced longitudinal frame members, or guides, above the floor, and a pair of spring biased handles which a person grips and slides along the guides in opposition to the spring bias.

SUMMARY OF THE INVENTION

It is an object of this invention to provide a torso exerciser which facilitates the use of the common push-up position in the development of the upper torso.

It is a further object of the invention to provide a torso exerciser which is convertible for use as an exerciser for use in development of the user's muscles in the inside and outside areas of the knees and in the groin areas.

It is a further object of the invention to provide an exerciser which comprises an elongated frame supported close to the floor, or other horizontal support surface which includes a pair of spaced parallel longitudinal frame members which serve as guides for a pair of handles which are slidably mounted relative to the guides and which are spring biased to neutral positions on opposite sides of the longitudinal center of the guides. Movement of the handles in either direction away from the neutral position is resisted by the spring bias.

It is a further object of this invention to provide a torso exerciser which is convertible to a leg exerciser.

BRIEF DESCRIPTION OF THE DRAWINGS

With the foregoing more important objects and features in view and such other objects and features which may become apparent as this specification proceeds, the invention will be understood from the following description taken in conjunction with the accompanying drawings, in which like characters of reference are used to designate like parts, and in which.

DETAILED DESCRIPTION OF THE PREFERRED EMBODIMENT

Figures 1, 2, 3, 4, 10:
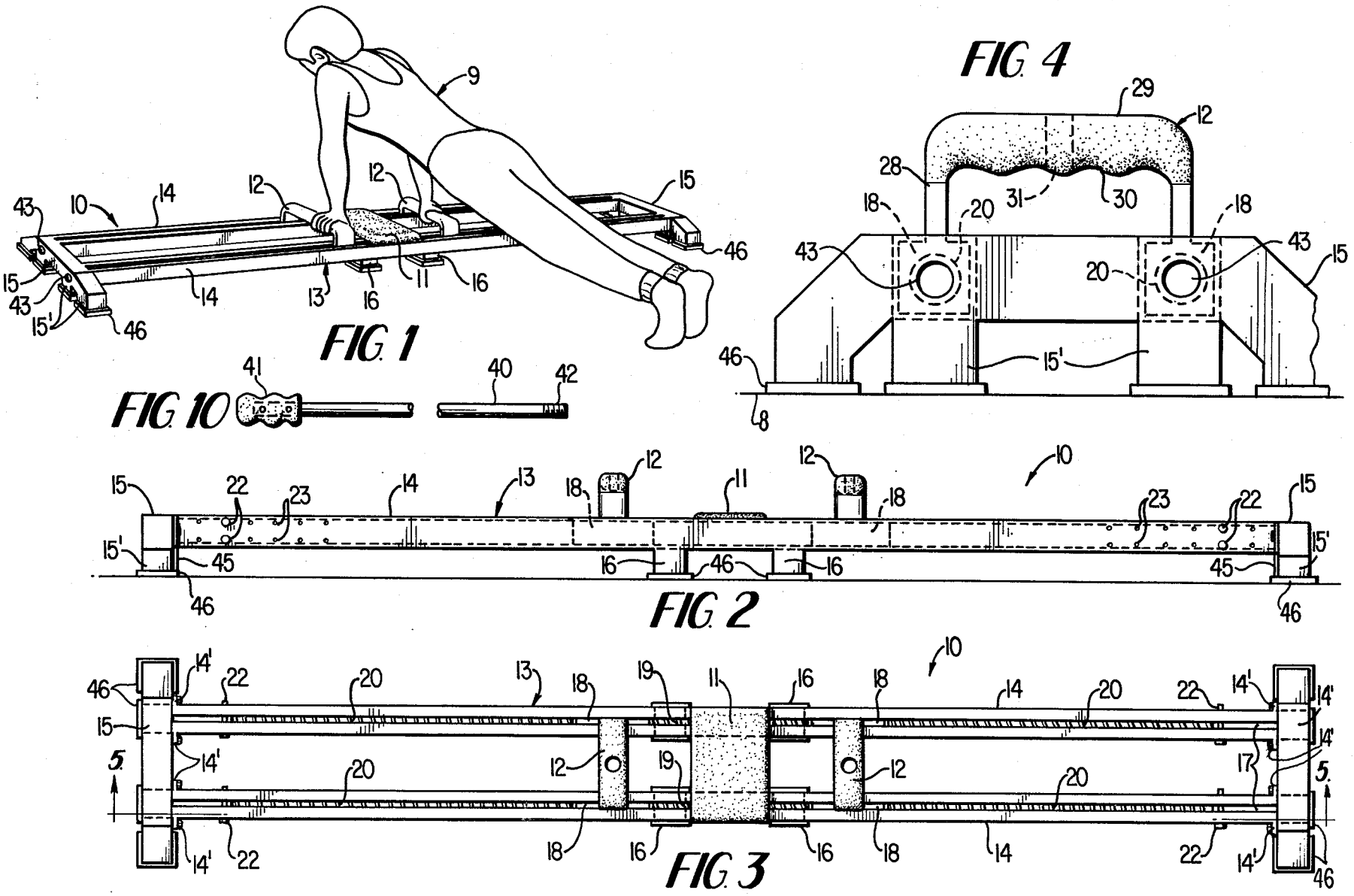
FIG. 1 is a perspective view of a preferred embodiment of the invention showing a person in the common push-up position for using the invention.
FIG. 2 is a front elevational view of the device shown in FIG. 1.
FIG. 3 is a top plan view of the device shown in FIG. 1.
FIG. 4 is an end view of the device shown in FIG. 1 on an enlarged scale.
FIG. 10 is an elevational view of a spring adjusting rod for use in making adjustment of the invention.

Refering now to the drawings and particularly to FIG. 1 a preferred embodiment of the exerciser of this invention is generally indicated by the numeral 10. FIG. 1 shows the exerciser 10 supported upon a generally horizontal surface 8 and a person or user 9 in the normal position for performing push-up exercises. The person's body is outstretched substantially perpendicular to the exerciser 10, and the chest is supported above a cushion, or chest pad 11 at the center of the exerciser by the person extending the arm downwardly and grasping a pair of spaced handles 12, 12 with his hands. The person's legs extend perpendicularly outwardly from the exerciser and are supported above the horizontal surface 8 by the person's feet.

The exerciser 10 comprises an elongated frame 13, having an elongated pair of transversely spaced, parallel longitudinal members 14, 14 and a pair of opposite end support members 15, 15 which rigidly connect the longitudinal members at their opposite ends and support the longitudinal members above the horizontal surface 8 and parallel thereto. A chest pad 11 of suitable cushion material is provided at the longitudinal center of the frame 13 and it extends transversely across the top of the frame over the longitudinal members 14, 14. Additional legs 16, 16 depend from each of the longitudinal members 14, 14 on opposite sides of the chest pad 11 to provide support for the frame is the area of the greatest concentration of the weight of the user.

The longitudinal frame members 14, 14 are hollow metal tubes of rectangular cross sectional configuration. The opposite ends of the tubes 14, 14 each have oppositely extending lateral flanges 14' by which the ends of the tubes are bolted, welded or otherwise rigidly secured to the transverse end support members 15, 15 which span the distance between the two tubes 14, 14 and which have short legs 15' which support the tubes 14, 14 above a horizontal surface. The upper wall of each longitudinal frame member 14 has a linear longitudinal slot 17 of uniform width which provides access to the hollow interior of the longitudinal frame member.

Within each of the hollow tubes 14, 14 are slidably mounted a pair of rectangular slide blocks 18, 18. The blocks 18, 18 within each tube are separated by a compression coil spring 19, and are each spaced from the ends of tube 14 by a compression coil spring 20 positioned on opposite sides of the blocks from the spring 19. Welded to the opposite ends of each of the springs 19 and 20 are rectangular bearing plates 21 which slide within the tube 14 in which they are located. The end of each of the springs 20 remote from the slide blocks 18 are adjustably spaced from the ends of the tube 14 in which they are mounted at selected distances by means of a pair of transverse pins 22 which are inserted behind the bearing plate 21 at the end of the spring through selected sets of parallel and vertically alined holes 23 extending through the tube 14 at longitudinally spaced intervals. The slide blocks 18 are biased by the springs 19 and 20 to neutral positions as shown in FIGS. 1–3.

Figure 6:
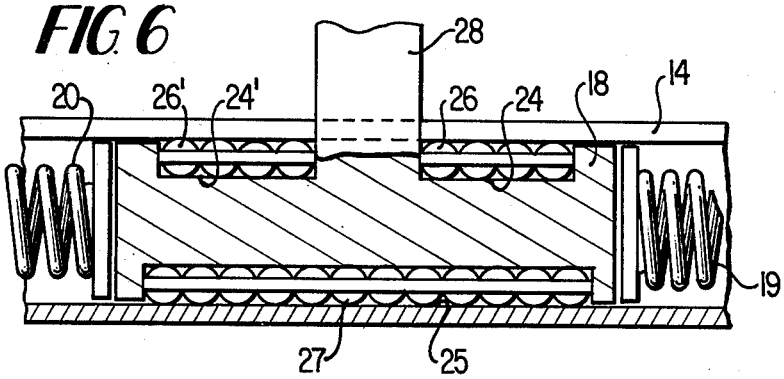
FIG. 6 is an enlarged sectional view of a detail shown in FIG. 5.

Each of the blocks 18 has upper recesses 24, 24' and a lower recess 25 in which are positioned sets of antifriction bearings 26, 26' and 27 respectively which mount the blocks 18 to slide freely in the tubes 14. Each pair of transversely alined slideblocks 18 support the legs 28, 28 depending from opposite ends of one of the handles 12. The lower ends of the legs 28 are joined integrally with the upper surface of the blocks 18, or they may be otherwise rigidly secured thereto, at the longitudinal mid portion of the block as seen in FIG. 6. The upper ends of legs 28 are formed integrally with the opposite ends of an intermediate hand grip portion 29 and are perpendicular thereto. The underside of the intermediate handgrip portion 29 is undulated as at 30 to enable the user to grip the handle firmly without danger of slipping.

Figure 7:
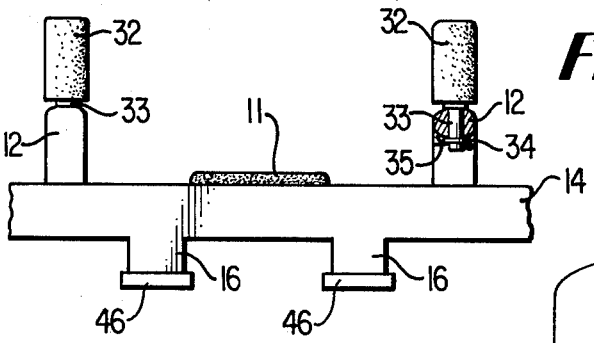
FIG. 7 is a front elevational view of the center portion of the device shown in FIG. 2 but with vertically oriented rollers supported by the handles thus converting the aparatus for exercise of the legs and muscles in the groin area of the user.
Figure 8:
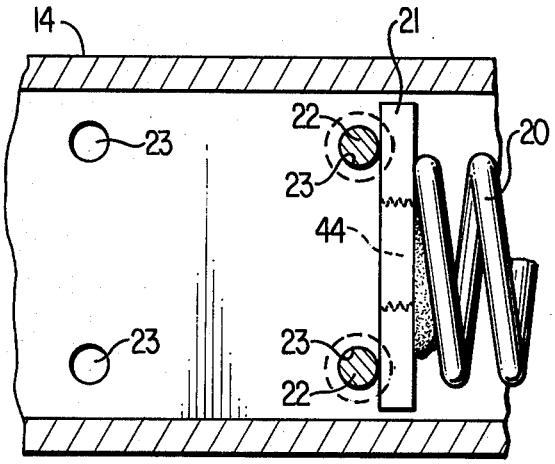
FIG. 8 is an enlarged sectional view showing a detail of the device shown in FIG. 5.
Figure 9:
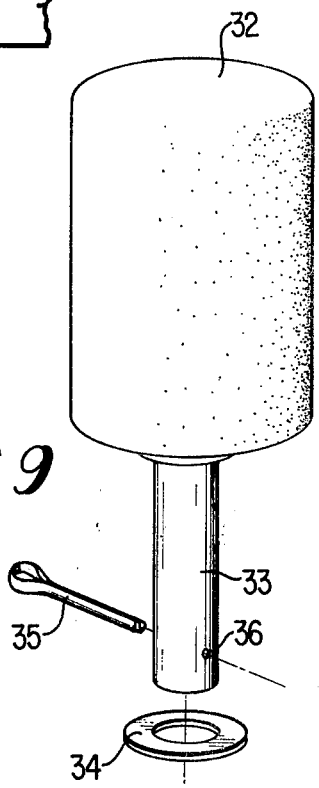
FIG. 9 is an exploded perspective view of the roller assembly shown in FIG. 7 for modifying the device of FIG. 1 for use in exercising the legs and muscles in the groin area.

A vertical hole 31 extends through the center of each of handles 12 to receive a cylindrical shank 33. On the upper end of each shank 33 is affixed a cushioned roller 32. When the shank 33 is positioned in one of the holes 31 as seen in FIG. 7, the lower end of the shank projects from the under side of the handle 12 and is secured within the hole 31 by first slipping a washer 34 over the lower end of the shank to a position where it is above a transverse hole through the shank, and by then inserting a cotter pin 35 through the hole 36 and bending the ends of the pin over to retain the cotter pin in place.

As previously described the invention is designed to develope the upper torso, the inside and outside areas of the knees and the groin areas of both legs. It accomplishes this better than other comparable exercisers because it is based on a stationary foundation which eliminates any "balancing" by the user of anything other than his own body. The user may begin in the push-up position and he may do push-ups if he so desires, or he may broaden his cardiovascular and muscular development by attempting what might be called a "push out – pull in" exercise. This exercise is designed to help increase and stimulate cardiovascular and muscular development. The user will be making use of all muscles in the arms, chest, neck, upper back and to a lesser degree the lower back and abdominal muscles. The user accomplishes the "push out – pull in" exercise by starting in the upright push-up position with his hands on the sliding handles 12, 12, arms fully extended, knees fully extended and only his toes touching the floor. He then proceeds to push out on the handles 12, 12 until his arms are fully extended laterally. When this position is reached he then pulls the handles inward until he is back to the starting position.

Not only can this exerciser be used to develope the upper torso, but it can also be adapted to develope areas of the legs, expecially the knees and the hamstrings in the groin areas. This can be accomplished by attaching two upright padded rollers 32, 32 to the tops of the handles 12 as seen in FIG. 7. The user would then lay on his back and place his feet between the handles 12, 12 and against the rollers 32, 32. He would then spread his legs by pushing the rollers out in the same manner that he pushed out on the handles with his hands. The spring action of the coils 20 would permit the rollers 32 to return to their original position, but at the same time exercise the legs while returning to this position. This would primarily work on the outside areas of the legs and knees.

To work on the inside areas of the legs and hamstrings the user could place his feet on the outside of the padded rollers and try to push the rollers closer together. This would basically be an isometric exercise, but with the coil 19 between the rollers 32 this would allow for the user to compress the coil 19 which would allow for greater stress on the inner leg. This exercise itself would prove most beneficial to athletes who suffer from pulled groin or hamstrings and it would also be very helpful for anyone recuperating from knee surgery, expecially when cartilage has been removed.

The chest pad 11 is placed between the handles to protect the user from injury should he or she fall while having their arms extended laterally. Instead of falling onto the longitudinal members 14 the user would simply fall onto the padded chest protector 11.

While the longitudinal members 14, 14 are shown as hollow tubes of rectangular cross section, it is to be understood they may be cylindrical or of other uniform polygonal cross sectional configuration throughout their length. The slide blocks 18 and the bearing plates 21 would have a configuration corresponding to the interior cross section of the hollow tubes, only they would be slightly smaller in order to slide freely within the tubes.

Figure 5:
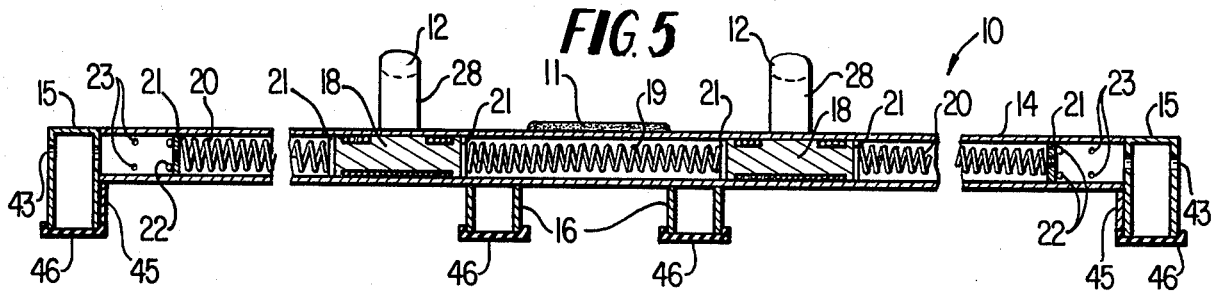
FIG. 5 is a vertical sectional view taken on lines 5—5 of FIG. 3 with portions broken away.

Also it is within the scope of this invention that the longitudinal members can be solid bars having slides for supporting the handles 12 mounted on the outside of the bars. The compression springs 19 and 20 would then be telescoped over the bars in the same relative positions with respect to the handles 12, 12 and the ends of the longitudinal members as shown in FIG. 5 of the preferred embodiment.

The antifriction bearings 26, 26' and 27 can be ball bearings or roller bearings depending upon which would be most economical and most suitable to meet the requirements of the particular cross sectional configuration of the longitudinal members 14, 14.

It should further be noted that the slide blocks 18 are free of any attachment to the coil springs on opposite sides thereof. Also the neutral positions of the handles 12, 12 will be shifted when the compression of the springs 20 is varied by moving the pins 22 behind the outer ends of the springs 20 to different selected sets of vertically alined holes 22, 22. The neutral positions of the handles 12, 12 are those positions which the handles assume when the forces on opposite sides thereof exerted by the springs 19 and 20 are balanced. Increasing the distance between the pins 22, 22 and the outer ends of the longitudinal members increases the compression of the springs 20 and thus increases the bias force exerted by the springs 20 on the slides 18 opposing movement of the handles outwardly in the direction of the ends of the longitudinal members. Decreasing the distance between the pins 22, 22 and the outer ends of the longitudinal members, decreases the compression of the springs 20 and decreases the bias exerted by the springs 20 on the slides 18.

A spring adjusting rod 40 is provided for use in adjusting the springs 20. The spring adjusting rod 40 is a solid metal rod having a hand grip 41 at one end and screw threads 42 at its other end. The end support members 15, 15 have a pair of holes 43, 43 extending therethrough coaxially with the longitudinal axis of the longitudinal members 14, and the outer bearing plates 21 closest to the end support members 15 each have a threaded hole 44 therein in alignment with one of the holes 43 to threadedly engage the threaded end of the spring adjust rod 40. When it is desired to adjust the springs 20, the threaded end of the spring adjust rod 40 is inserted through one of the holes 43 from the outer end of one of the end support 15 into the longitudinal member 14 aligned therewith and is threadedly engaged in the threaded hole 44 in the bearing plate 21. By pushing inward on the spring adjust rod 40, the spring can be compressed the desired amount to permit the pins 22 to be positioned appropriately to hold the spring 20 compressed the desired amount. Each of the springs 20 will be adjusted in turn in a similar manner.

An optional but desirable feature of the invention is the provision of inwardly extending ledges 45 on which the ends of the longitudinal members 14 rest. These ledges give vertical support to the ends of the longitudinal members and reduce the load applied to the means securing the longitudinal members 14 to the end support members 15.

Rubber caps 46 are provided on the foot of each of the legs 15' and 16 to prevent the exerciser from slipping and scratching the surface supporting the exerciser.

It is further within the scope of this invention to make the handles 29 separable from the slide blocks 18 and support legs 28. By having the handles 29 separable from the support blocks 18, and by bolting the longitudinal members 14, 14 to the end members 15, 15, the exerciser 10 can be readily disassembled for storage, shipment, and repair. Also various parts which may become worn or broken over extended periods of use may be readily replaced.

While the slide blocks 18 are shown to have antifriction bearings on the top and bottom sides thereof, it will be understood that additional antifriction bearings can be interposed between the vertical sides of the blocks 18 and vertical walls of the tubes 14.

The torso exerciser of this invention makes use of the user's own body weight as a variable which in time the user should be able to overcome. If desired, additional weights could be attached to the user to increase this variable.

While in the foregoing there has been described and shown a preferred embodiment of the invention, various modifications and equivalents may be restored to within the spirit and scope of the invention as claimed.

What is claimed is:

1. A torso exerciser for use by a person in the common push-up exercising position in the development of the upper torso comprising an elongated frame including a pair of transversely spaced parallel longitudinal members having opposite ends and support means for rigidly connecting said pair of longitudinal members and for supporting said longitudinal members above and parallel to a horizontal support surface, a pair of elongated handles, means for slidably mounting said handles to slide on said longitudinal members in parallel relationship to each other and with each handle transversely spaced above said longitudinal members, first resilient bias means supported by said longitudinal members between said handles for resiliently opposing sliding motion of said handles from a neutral spaced apart position toward each other, and additional resilient bias means supported by said longitudinal members on the opposite side of each of said handles from said first resilient bias means to resiliently oppose sliding motion of said handles from said neutral spaced apart position away from each other, a chest pad mounted in the mid section of said frame between said handles.

2. A torso exerciser for use by a person in the common push-up exercising position in the development of the upper torso comprising an elongated frame including a pair of transversely spaced parallel longtiduinal members having opposite ends and support means for rigidly connecting said pair of longitudinal members and for supporting said longitudinal members above and parallel to a horizontal support surface, a pair of elongated handles, means for slidably mounting said handles to slide on said longitudinal members in parallel relationship to each other and with each handle transversely spaced above said longitudinal members, first resilient bias means supported by said longitudinal members between said handles for resiliently opposing sliding motion of said handles from a neutral spaced apart position toward each other, and additional resilient bias means supported by said longitudinal members on the opposite side of each of said handles from said first resilient bias means to resiliently oppose sliding motion of said handles from said neutral spaced apart position away from each other, together with means for converting said exerciser for use in exercising the legs and muscles of the groin area, said converting means comprising a pair of padded rollers, each roller having a shank projecting from one end thereof, a vertically oriented hole in each of said handles for receiving the shank of a different one of said rollers, and separate means for retaining the shanks of said rollers in said holes when said rollers are positioned above said handles with their shanks projecting downwardly through said holes, said exerciser when converted to use as a leg and grain muscle exerciser being used by a person lying on the horizontal support surface on which the exerciser is supported with the legs outstretched and engaging said rollers on either side thereof.

3. A torso exerciser for use by a person in the common push-up exercising position in the development of the upper torso comprising an elongated frame including a pair of transversely spaced parallel longitudinal members having opposite ends and support means for rigidly connecting said pair of longitudinal members and for supporting said longitudinal members above and parallel to a horizontal support surface, a pair of elongated handles, means for slidably mounting said handles to slide on said longitudinal members in parallel relationship to each other and with each handle transversely spaced above said longitudinal members, first resilient bias means supported by said longitudinal members between said handles for resiliently opposing sliding motion of said handles from a neutral spaced apart position toward each other, and additional resilient bias means supported by said longitudinal members on the opposite side of each of said handles from said first resilient bias means to resiliently oppose sliding motion of said handles from said neutral spaced apart position away from each other, each of said longitudinal members have a hollow tube with an open slot extending longitudinally along the top side thereof, each of said handles having a pair of downwardly depending parallel legs and a hand grip portion intermediate said legs and normal thereto, each of said legs of said handle extending downwardly through the open slot of a different one of said longitudinal member, said means for slidably mounting said handles comprising two pairs of slide blocks, each pair of said slide blocks being rigidly connected to the depanding legs of a different one of said handles with the individual blocks of each pair being slidably mounted within the hollow interior of a different one of said longitudinal members, said first resilient bias comprising a first pair of compression coil springs, each individual spring of said first pair of coil springs being supported within a different one of said longitudinal members between the slide blocks connected to corresponding ends of said pair of handles, said additional resilient bias means comprising a second and third pair of compression coil springs, each of the individual coil springs of said second pair of coil springs being mounted within different ones of said longitudinal members and corresponding sides of the slide blocks attached to one of said handles, and each of the individual springs of said third pair of coil springs being mounted within different ones of said longitudinal members between the other corresponding ends thereof and corresponding sides of the slide blocks attached to the other of said handles.

4. The exerciser according to claim 3 wherein means is provided to selectively vary the space between the springs of said second and third pair of springs and respective ends of said longitudinal members in order to vary the bias of said second and third pair of springs opposing the sliding motion of said handles.

5. The exerciser according to claim 4 wherein the support means for rigidly connecting said pair of longitudinal members and for supporting said longitudinal members above and parallel to a horizontal support surface, comprises a pair of end support members rigidly connected transversely across opposite ends of said pair of longitudinal members.

6. The exerciser according to claim 5 wherein each of the end support members of said pair has a pair of holes extending therethrough, each of the holes being in coaxial alignment with the longitudinal axis of a different one of said longitudinal members and providing access from outside of said end support members to the interior of said longitudinal members for the insertion of a spring adjust rod, and a spring adjust rod insertable through one of said holes to apply pressure against the outer end of one of the springs of said second and third pair for pushing the inner end of the spring inward to a selected position of adjustment.

7. The exerciser according to claim 3 wherein anti-friction bearings are provided to support each of said slide blocks in said hollow longitudinal members.

8. The exerciser of claim 3 wherein each of the springs of said first, second and third pair of coil springs have flat bearing plates attached thereto.

9. The exerciser of claim 3 wherein each of the slide blocks of said two pairs is free of any attachment to the coil springs which oppose motion thereof.

* * * * *